US009721725B2

(12) United States Patent
Kido et al.

(10) Patent No.: US 9,721,725 B2
(45) Date of Patent: Aug. 1, 2017

(54) ELECTRONIC COMPONENT AND MANUFACTURING METHOD THEREOF

(71) Applicant: MURATA MANUFACTURING CO., LTD., Kyoto (JP)

(72) Inventors: Tomohiro Kido, Nagaokakyo (JP); Miho Kitamura, Nagaokakyo (JP); Tetsuzo Hara, Nagaokakyo (JP); Nobuhiro Ishida, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 15/146,600

(22) Filed: May 4, 2016

(65) Prior Publication Data

US 2016/0247630 A1 Aug. 25, 2016

Related U.S. Application Data

(60) Division of application No. 14/162,683, filed on Jan. 23, 2014, now Pat. No. 9,362,043, which is a (Continued)

(30) Foreign Application Priority Data

Aug. 31, 2011 (JP) ..... 2011-188180

(51) Int. Cl.
*H01B 13/00* (2006.01)
*H01F 41/04* (2006.01)
(Continued)

(52) U.S. Cl.
CPC ..... *H01F 41/042* (2013.01); *H01F 17/0013* (2013.01); *H01F 27/24* (2013.01);
(Continued)

(58) Field of Classification Search
CPC ..... H01F 17/0013; H01F 2017/0066; H01F 2017/0093; H01F 2027/2809; H01F 27/24;
(Continued)

(56) References Cited

U.S. PATENT DOCUMENTS 5,600,101 A 2/1997 Sakai
8,050,045 B2 11/2011 Okuzawa et al.
(Continued)

FOREIGN PATENT DOCUMENTS

CN 1929050 A 3/2007
CN 100538925 C 9/2009
(Continued)

OTHER PUBLICATIONS

International Search Report; PCT/JP2012/071972; Oct. 2, 2012.
(Continued)

*Primary Examiner* — Lan Vinh
(74) *Attorney, Agent, or Firm* — Studebaker & Brackett PC

(57) ABSTRACT

A magnetic substrate has such a shape that ridges extending between principal surfaces are cut away by cutout portions. A multilayer body has corners arranged so as to overlap the cutout portions. A coil includes lead portions which are connected with both ends of a coil portion and which are drawn out to the corners. A coil is combined with the coil to constitute a common mode choke coil and includes lead portions which are connected with both ends of a coil portion and which are drawn out to the corners. Connecting portions connect external electrodes to the lead portions and are provided at the cutout portion.

4 Claims, 14 Drawing Sheets

Related U.S. Application Data continuation of application No. PCT/JP2012/071972, filed on Aug. 30, 2012.

(51) Int. Cl.

| | |
|---|---|
| ***H01F 27/28*** | (2006.01) |
| ***H01F 27/29*** | (2006.01) |
| ***H01F 17/00*** | (2006.01) |
| ***H01F 27/24*** | (2006.01) |

(52) U.S. Cl.

CPC ..... *H01F 27/2804* (2013.01); *H01F 27/29* (2013.01); *H01F 27/292* (2013.01); *H01F 41/046* (2013.01); *H01F 2017/0066* (2013.01); *H01F 2017/0093* (2013.01); *H01F 2027/2809* (2013.01); *Y10T 29/49078* (2015.01)

(58) Field of Classification Search

CPC .... H01F 27/2809; H01F 27/29; H01F 27/292; H01F 41/042; H01F 41/046; H01F 41/06; H01F 27/28

USPC ..... 216/13, 14, 17, 22; 336/192, 200, 208; 438/611, 614, 622, 667, 720

See application file for complete search history.

(56) References Cited

U.S. PATENT DOCUMENTS

| | | | | |
|---|---|---|---|---|
| 8,320,093 | B2 | 11/2012 | Asakawa | |
| 8,514,539 | B2 | 8/2013 | Asakawa | |
| 2005/0118969 | A1 | 6/2005 | Shoji | |
| 2005/0181684 | A1 | 8/2005 | Ito | |
| 2005/0253677 | A1 | 11/2005 | Ito | |
| 2006/0097835 | A1 | 5/2006 | Tomonari | |
| 2007/0040163 | A1* | 2/2007 | Okuzawa | H01F 27/292 257/31 |
| 2007/0205856 | A1* | 9/2007 | Matsunaga | H01F 17/0013 336/200 |
| 2010/0157565 | A1* | 6/2010 | Yoshida | H01F 27/292 361/811 |
| 2011/0291790 | A1* | 12/2011 | Okumura | H01F 17/0013 336/200 |
| 2012/0112869 | A1 | 5/2012 | Nishikawa | |
| 2012/0133472 | A1 | 5/2012 | Nishikawa | |
| 2012/0249282 | A1 | 10/2012 | Sin | |
| 2014/0139307 | A1* | 5/2014 | Kido | H01F 27/2804 336/192 |

FOREIGN PATENT DOCUMENTS

| | | | |
|---|---|---|---|
| JP | S61-38901 | U | 3/1986 |
| JP | H06-112099 | A | 4/1994 |
| JP | 07-106144 | A | 4/1995 |
| JP | 08-203737 | A | 8/1996 |
| JP | 10-126205 | A | 5/1998 |
| JP | 2006-210541 | A | 8/2006 |
| JP | 2007-053254 | A | 3/2007 |
| JP | 2011-014747 | A | 1/2011 |
| JP | 2011-071457 | | 4/2011 |
| JP | 2012-015493 | A | 1/2012 |
| JP | 2012-015494 | A | 1/2012 |

OTHER PUBLICATIONS

Written Opinion of the International Searching Authority; PCT/JP2012/071972; Oct. 2, 2012.

An Office Action; "Notification of Reasons for Refusal," issued by the Japanese Patent Office on Sep. 2, 2014, which corresponds to Japanese Patent Application No. 2013-531389 and is related to U.S. Appl. No. 14/162,683; with English language translation.

* cited by examiner

ELECTRONIC COMPONENT AND MANUFACTURING METHOD THEREOF

CROSS REFERENCE TO RELATED APPLICATIONS

This application is a Divisional of U.S. application Ser. No. 14/162,683 filed Jan. 23, 2014, which claims benefit of priority to Japanese Patent Application No. 2011-188180 filed Aug. 31, 2011, and to International Patent Application No. PCT/JP2012/071972 filed on Aug. 30, 2012, the entire content of each of which is incorporated herein by reference.

TECHNICAL FIELD

The present technical field relates to an electronic component and a manufacturing method thereof, and more specifically relates to an electronic component which includes a common mode choke coil and a manufacturing method thereof.

BACKGROUND

An example of known conventional electronic components is an electronic component described in Japanese Laid-Open Publication No. 2007-53254. FIG. 13 is a perspective view of the exterior of an electronic component 500 as described in Japanese Laid-Open Publication No. 2007-53254.

The electronic component 500 is a common mode choke coil, which includes a silicon substrate 502, a multilayer body 504, external electrodes 506 (506*a* to 506*d*), and contact holes 508 (508*a* to 508*d*). The multilayer body 504 is formed by stacking a plurality of insulator layers on the silicon substrate 502. The upper surface of the multilayer body 504 is provided with the external electrodes 506. The inside of the multilayer body 504 is provided with two coil conductors (not shown). Both ends of the two coil conductors and the external electrodes 506 are electrically coupled via the contact holes 508.

The electronic component 500 that is configured as described above has a disadvantage that it is difficult to obtain a common mode choke coil which has sufficient impedance. More specifically, a magnetic flux is unlikely to pass through the contact holes 508. Therefore, when the contact holes 508 are provided in the multilayer body 504, a magnetic flux generated by coil conductors is unlikely to pass through the contact holes 508. As a result, the coil conductors are incapable of having a sufficient inductance value, and a common mode choke coil formed by the coil conductors is incapable of having sufficient impedance.

SUMMARY

Problems to be Solved by the Disclosure

An object of the present disclosure is to provide an electronic component including a common mode choke coil which has high impedance and a manufacturing method thereof.

Solution to Problems

An electronic component according to one embodiment of the present disclosure includes: a first magnetic substrate having a shape of a substantially rectangular parallelepiped which has mutually opposing first and second principal surfaces, the first magnetic substrate having such a shape that a first ridge extending between the first principal surface and the second principal surface is cut away by a first cutout portion; a multilayer body which is constituted of a plurality of insulator layers stacked on the first principal surface, the multilayer body having a substantially rectangular shape which has a first corner that is arranged so as to overlap the first cutout portion when viewed in plan from a stacking direction; a first coil provided in the multilayer body, the first coil including a first coil portion and a first lead portion which is connected with one end of the first coil portion and which is drawn out to the first corner; a second coil which is provided in the multilayer body and which is combined with the first coil to constitute a common mode choke coil, the second coil including a second coil portion which is magnetically coupled with the first coil portion; a first external electrode provided on the second principal surface; and a first connecting portion that connects the first external electrode to the first lead portion, the first connecting portion being provided at the first cutout portion.

A method for manufacturing the above-described electronic component includes: the first step of preparing a mother body in which a mother multilayer body that is a precursor of the multilayer body is interposed between a first mother substrate that is a precursor of the first magnetic substrate and a second mother substrate that is a precursor of the second magnetic substrate; the second step of forming through holes at positions in the first mother substrate at which the first through fourth cutout portions are to be formed; the third step of forming a conductor layer on an inner perimeter surface of the through holes, thereby forming the first through fourth connecting portions; the fourth step of forming a conductor layer on the second principal surface of the first mother substrate, thereby forming the first through fourth external electrodes; and the fifth step of cutting the mother body.

DETAILED DESCRIPTION

Hereinafter, an electronic component and a manufacturing method thereof according to an embodiment of the present disclosure are described.

Configuration of Electronic Component

Figure 1:
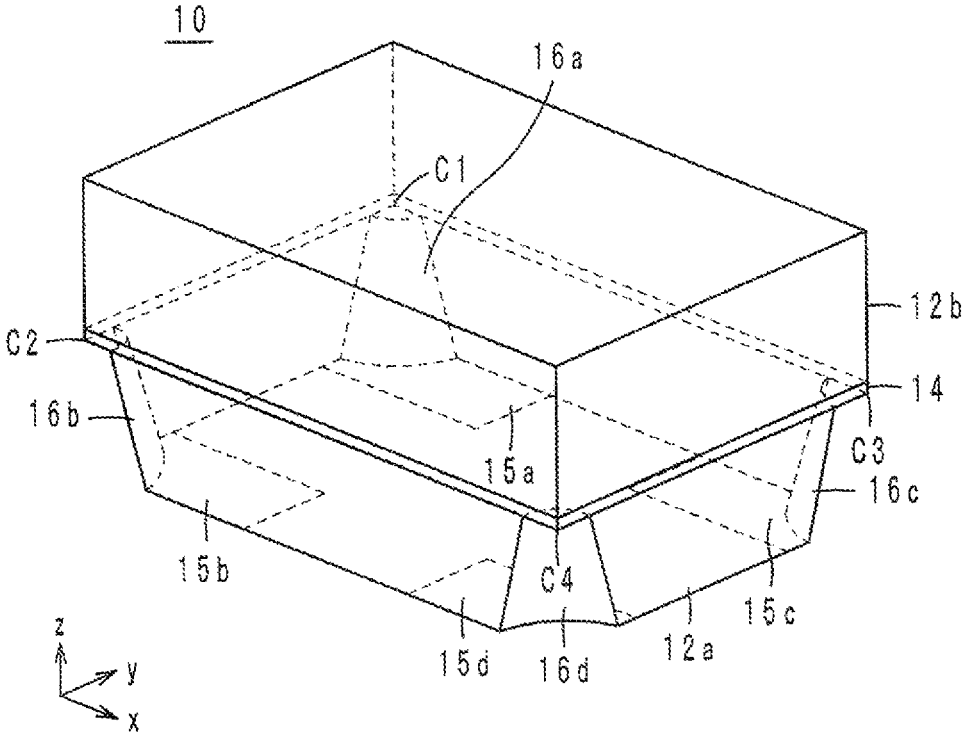
FIG. 1 is a perspective view of the exterior of an electronic component according to one embodiment.
Figure 2:
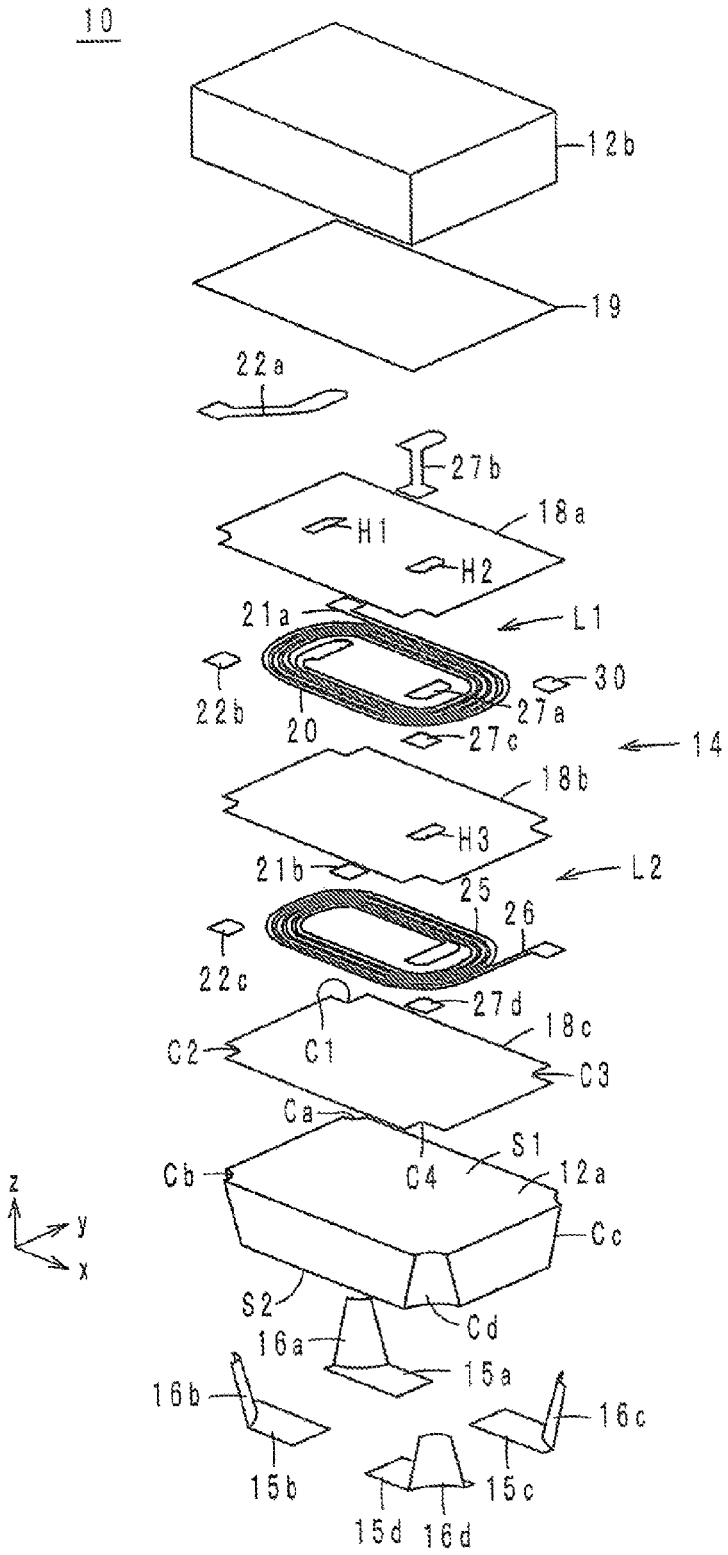
FIG. 2 is an exploded perspective view of the electronic component of FIG. 1.
Figure 3A:
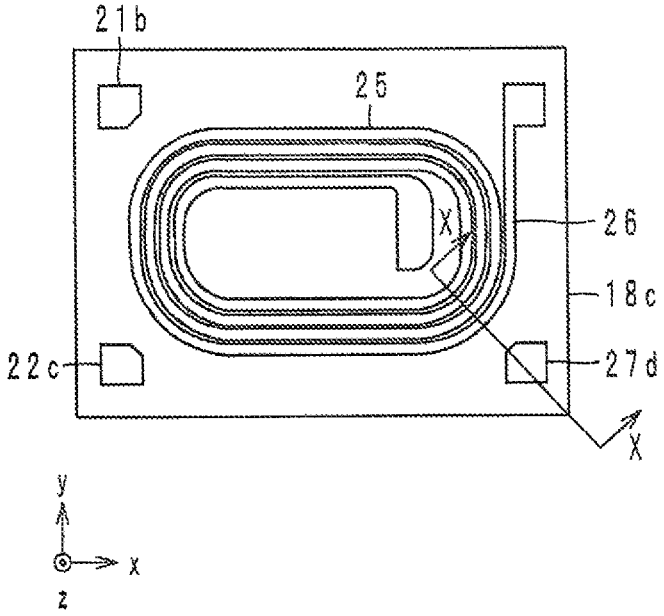
FIG. 3A is a diagram showing a coil portion and an insulator layer which are viewed in plan from the z-axis direction.
Figure 3B:
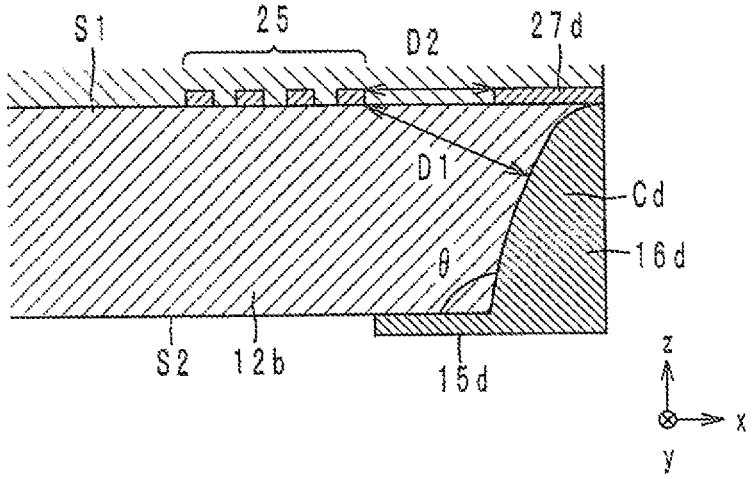
FIG. 3B is a cross-sectional configuration diagram taken along line X-X of FIG. 3A.

Firstly, the configuration of an electronic component according to one embodiment of the present disclosure is described with reference to the drawings. FIG. 1 is a perspective view of the exterior of an electronic component 10 according to one embodiment. FIG. 2 is an exploded perspective view of the electronic component 10 of FIG. 1. FIG. 3A is a diagram showing a coil portion 25 and an insulator layer 18*c*, which are viewed in plan from the z-axis direction. FIG. 3B is a cross-sectional configuration diagram taken along line X-X of FIG. 3A. In the following description, the stacking direction of the electronic component 10 is defined as the "z-axis direction". When viewed in plan from the z-axis direction, a direction in which the long side of the electronic component 10 extends is defined as the "x-axis direction", and a direction in which the short side of the electronic component 10 extends is defined as the "y-axis direction". Viewing in plan from the positive direction side of the z-axis direction is simply referred to as "viewing in plan from the z-axis direction".

The electronic component 10 includes magnetic substrates 12*a*, 12*b*, a multilayer body 14, external electrodes 15 (15*a* to 15*d*), connecting portions 16 (16*a* to 16*d*), and coils L1, L2 as shown in FIG. 1 and FIG. 2.

The magnetic substrate 12*a* has a shape of a substantially rectangular parallelepiped which has mutually opposing principal surfaces S1, S2. In the magnetic substrate 12*a*, the principal surface S1 is positioned at the positive direction side of the z-axis direction with respect to the principal surface S2. Note that the magnetic substrate 12*a* has such a shape that four ridges extending between the principal surfaces S1, S2 are cut away by cutout portions Ca to Cd. Hereinafter, the shape of the magnetic substrate 12*a* is described in more detail.

The cutout portions Ca to Cd refer to spaces which are formed by cutting away portions near the ridges. The cutout portion Ca is a space on the negative direction side of the x-axis direction, and is formed by cutting away the ridge on the positive direction side of the y-axis direction. The cutout portion Cb is a space on the negative direction side of the x-axis direction, and is formed by cutting away the ridge on the negative direction side of the y-axis direction. The cutout portion Cc is a space on the positive direction side of the x-axis direction, and is formed by cutting away the ridge on the positive direction side of the y-axis direction. The cutout portion Cd is a space on the positive direction side of the x-axis direction, and is formed by cutting away the ridge on the negative direction side of the y-axis direction.

The magnetic substrate 12*a* is cut out from sintered ferrite ceramics. Alternatively, the magnetic substrate 12*a* may be prepared by applying a paste which includes ferrite calcined powder and a binder onto ceramic substrate, such as alumina. Still alternatively, the magnetic substrate 12*a* may be prepared by stacking green sheets of a ferrite material and baking the resultant structure.

Portions of the magnetic substrate 12*a* near the ridges extending in the z-axis direction are cut away such that the cutaway portions have a bell-like shape (i.e., dome-like shape) which is tapered from the principal surface S2 to the principal surface S1, i.e., toward the positive direction side of the z-axis direction. Therefore, when viewed in plan from the z-axis direction, the area of the cutout portions Ca to Cd decreases as it approaches from the principal surface S2 to the principal surface S1 (i.e., as it approaches toward the positive direction side of the z-axis direction). The surfaces that define the cutout portions Ca to Cd form obtuse angles θ with respect to the principal surface S2 as shown in FIG. 3B.

The multilayer body 14 is formed by a plurality of insulator layers 18*a* to 18*c* stacked on the principal surface S1 and an organic adhesive agent layer 19. When viewed in plan from the z-axis direction, the multilayer body 14 has a substantially rectangular shape which has corners C1 to C4 that are arranged so as to overlap the cutout portions Ca to Cd, respectively. The insulator layers 18*a* to 18*c* are stacked up in this order from the positive direction side of the z-axis direction and have a substantially equal size to the principal surface S1. Note that the corners of the insulator layer 18*a* at the both ends of the long side on the negative direction side of the y-axis direction are cut away. Further, the insulator layer 18*a* has via holes H1, H2 penetrating therethrough in the z-axis direction. The four corners of the insulator layer 18*b* are cut away. Further, the insulator layer 18*b* has a via hole H3 penetrating therethrough in the z-axis direction. The via hole H3 and the via hole H2 are connected together. The four corners of the insulator layer 18*c* are cut away.

The insulator layers 18*a* to 18*c* are made of polyimide. Alternatively, the insulator layers 18*a* to 18*c* may be made of an insulative resin, such as benzocyclobutene, or may be made of an insulative inorganic material, such as glass ceramics. In the following description, one of the principal surfaces of the insulator layers 18*a* to 18*c* on the positive direction side of the z-axis direction is referred to as a "front surface", and the other principal surface of the insulator layers 18*a* to 18*c* on the negative direction side of the z-axis direction is referred to as a "rear surface".

The magnetic substrate 12*b* has a shape of a substantially rectangular parallelepiped. The magnetic substrate 12*b* is combined with the magnetic substrate 12*a* so as to sandwich the multilayer body 14 in terms of the z-axis direction. That is, the magnetic substrate 12*b* is placed on the multilayer body 14 at the positive direction side of the z-axis direction. The magnetic substrate 12*b* is cut out from sintered ferrite ceramics. Alternatively, the magnetic substrate 12*b* may be prepared by applying a paste, which is composed of ferrite calcined powder and a binder, onto a ceramic substrate, such as alumina. Still alternatively, the magnetic substrate 12*b* may be prepared by stacking green sheets of a ferrite material and baking the resultant structure.

The magnetic substrate 12*b* and the multilayer body 14 may be bonded together by an adhesive agent. In the present embodiment, the magnetic substrates 12*a*, 12*b* and the multilayer body 14 are bonded together by the organic adhesive agent layer 19.

The coil L1 is provided in the multilayer body 14 and includes a coil portion 20, lead portions 21*a*, 21*b*, which are typical examples of first lead portions, and lead portions 22*a* to 22*c*, which are typical examples of second lead portions.

The coil portion 20 is provided on the surface of the insulator layer 18*b*. When viewed in plan from the z-axis direction, the coil portion 20 has such a spiral shape that it circles around clockwise toward the center. The center of the coil portion 20 is substantially coincident with the center of the electronic component 10 (the intersection of the diagonals) when viewed in plan from the z-axis direction.

The lead portion 21*a* is provided on the surface of the insulator layer 18*b* and is connected with the outer end portion of the coil portion 20. The lead portion 21*a* is drawn out to the cutout portion at a corner of the insulator layer 18*b* which is on the negative direction side of the x-axis direction and on the positive direction side of the y-axis direction. The lead portion 21*a* penetrates through the insulator layer 18*b* in the z-axis direction via the cutout portion.

The lead portion 21*b* is a substantially quadrangular conductor provided in the cutout portion at a corner of the insulator layer 18*c* which is on the negative direction side of the x-axis direction and on the positive direction side of the y-axis direction. With this arrangement, the lead portion 21*b* is connected with the lead portion 21*a*. The lead portion 21*b* penetrates through the insulator layer 18*c* in the z-axis direction via the cutout portion.

The lead portions 21*a*, 21*b* that are configured as described above are connected with the end portion of the coil portion 20 and are drawn out to the corner C1 of the principal surface of the multilayer body 14 on the negative direction side of the z-axis direction. With this arrangement, the lead portion 21*b* is exposed at the cutout portion Ca when viewed in plan from the negative direction side of the z-axis direction.

The lead portion 22*a* is provided on the surface of the insulator layer 18*a* and is arranged so as to penetrate through the insulator layer 18*a* in the z-axis direction via the via hole H1, so that the lead portion 22*a* is connected with the inner end portion of the coil portion 20. The lead portion 22*a* is drawn out to the cutout portion at a corner of the insulator layer 18*a* which is on the negative direction side of the x-axis direction and on the negative direction side of the y-axis direction. The lead portion 22*a* penetrates through the insulator layer 18*a* in the z-axis direction via the cutout portion.

The lead portion 22*b* is a substantially quadrangular conductor provided in the cutout portion at a corner of the insulator layer 18*b* which is on the negative direction side of the x-axis direction and on the negative direction side of the y-axis direction. With this arrangement, the lead portion 22*b* is connected with the lead portion 22*a*. The lead portion 22*b* penetrates through the insulator layer 18*b* in the z-axis direction via the cutout portion.

The lead portion 22*c* is a substantially quadrangular conductor provided in the cutout portion at a corner of the insulator layer 18*c* which is on the negative direction side of the x-axis direction and on the negative direction side of the y-axis direction. With this arrangement, the lead portion 22*c* is connected with the lead portion 22*b*. The lead portion 22*c* penetrates through the insulator layer 18*c* in the z-axis direction via the cutout portion.

The lead portions 22*a* to 22*c* that are configured as described above are connected with the end portion of the coil portion 20 and are drawn out to the corner C2 of a principal surface of the multilayer body 14 which is on the negative direction side of the z-axis direction. With this arrangement, the lead portion 22*c* is exposed at the cutout portion Cb when viewed in plan from the negative direction side of the z-axis direction.

The coil portion 20 and the lead portions 21*a*, 21*b*, 22*a* to 22*c* are realized by forming a film of Ag by sputtering. The coil portion 20 and the lead portions 21*a*, 21*b*, 22*a* to 22*c* may be made of a material which has a high electrical conductivity, such as Cu, Au, or the like.

The coil L2 is provided in the multilayer body 14 and includes a coil portion 25, a lead portion 26, which is a typical example of a third lead portion, and lead portions 27*a* to 27*d*, which are typical examples of fourth lead portions. The coil portion 25 is provided on the surface of the insulator layer 18*c*. When viewed in plan from the z-axis direction, the coil portion 25 has such a spiral shape that it circles around clockwise toward the center. That is, the coil portion 25 circles around in the same direction as the coil portion 20. The center of the coil portion 25 is substantially coincident with the center of the electronic component 10 (i.e., the intersection of the diagonals) when viewed in plan from the z-axis direction. Therefore, when viewed in plan from the z-axis direction, the coil portion 25 overlaps the coil portion 20. Further, the coil portion 25 is provided at the negative direction side of the z-axis direction (i.e., near the magnetic substrate 12*a*) with respect to the coil portion 20. Thus, the coil L2 and the coil L1 constitute a common mode choke coil.

The lead portion 26 is provided on the surface of the insulator layer 18*c* and is connected with the outer end portion of the coil portion 25. The lead portion 26 is drawn out to the cutout portion at a corner of the insulator layer 18*c* which is on the positive direction side of the x-axis direction and on the positive direction side of the y-axis direction. The lead portion 26 penetrates through the insulator layer 18*c* in the z-axis direction via the cutout portion.

The lead portion 26 that is configured as described above is connected with the end portion of the coil portion 25 and is drawn out to the corner C3 of the principal surface of the multilayer body 14 which is on the negative direction side of the z-axis direction. With this arrangement, the lead portion 26 is exposed at the cutout portion Cc when viewed in plan from the negative direction side of the z-axis direction.

The lead portion 30 is a substantially quadrangular conductor provided in the cutout portion at a corner of the insulator layer 18*b* which is on the positive direction side of the x-axis direction and on the positive direction side of the y-axis direction. With this arrangement, the lead portion 30 is connected with the lead portion 26.

The lead portion 27*a* is a substantially quadrangular conductor which is provided on the surface of the insulator layer 18*b* and which is arranged so as to penetrate through the insulator layer 18*b* in the z-axis direction via the via hole H3, so that the lead portion 27*a* is connected with the inner end portion of the coil portion 25.

The lead portion 27*b* is provided on the surface of the insulator layer 18*a* and is arranged so as to penetrate through the insulator layer 18*a* in the z-axis direction via the via hole H2, so that the lead portion 27*b* is connected with the lead portion 27*a*. The lead portion 27*b* is drawn out to the cutout portion at a corner of the insulator layer 18*a* which is on the positive direction side of the x-axis direction and on the negative direction side of the y-axis direction. The lead portion 27*b* penetrates through the insulator layer 18*a* in the z-axis direction via the cutout portion.

The lead portion 27*c* is a substantially quadrangular conductor provided in the cutout portion at a corner of the insulator layer 18*b* which is on the positive direction side of the x-axis direction and on the negative direction side of the y-axis direction. With this arrangement, the lead portion 27*c* is connected with the lead portion 27*b*. The lead portion 27*c* penetrates through the insulator layer 18*b* in the z-axis direction via the cutout portion.

The lead portion 27*d* is a substantially quadrangular conductor provided in the cutout portion at a corner of the insulator layer 18*c* which is on the positive direction side of the x-axis direction and on the negative direction side of the y-axis direction. With this arrangement, the lead portion 27*d* is connected with the lead portion 27*c*. The lead portion 27*d* penetrates through the insulator layer 18*c* in the z-axis direction via the cutout portion.

The lead portions 27*a* to 27*d* that are configured as described above are connected with the end portion of the coil portion 25 and are drawn out to the corner C4 of the principal surface of the multilayer body 14 which is on the negative direction side of the z-axis direction. With this arrangement, the lead portion 27*d* is exposed at the cutout portion Cd when viewed in plan from the negative direction side of the z-axis direction.

The coil portion 25 and the lead portions 26, 27*a* to 27*d* are realized by forming a film of Ag by sputtering. The coil portion 25 and the lead portions 26, 27*a* to 27*d* may be made of a material which has a high electrical conductivity, such as Cu, Au, or the like.

The external electrodes 15 are provided on the principal surface S2 of the magnetic substrate 12*a* and have a substantially rectangular shape. More specifically, the external electrode 15*a* is provided near a corner of the principal surface S2 which is on the negative direction side of the x-axis direction and on the positive direction side of the y-axis direction. The external electrode 15*b* is provided near a corner of the principal surface S2 which is on the negative direction side of the x-axis direction and on the negative direction side of the y-axis direction. The external electrode 15*c* is provided near a corner of the principal surface S2 which is on the positive direction side of the x-axis direction and on the positive direction side of the y-axis direction. The external electrode 15*d* is provided near a corner of the principal surface S2 which is on the positive direction side of the x-axis direction and on the negative direction side of the y-axis direction. The external electrodes 15 are realized by forming a layered structure of a Au film, a Ni film, a Cu film, and a Ti film by sputtering. Alternatively, the external electrodes 15 may be realized by printing a paste which contains a metal, such as Ag, Cu, or the like, and baking the printed paste, or may be realized by forming a film of Ag, Cu, or the like, by vapor deposition or plating.

The connecting portions 16*a* to 16*d* connect the external electrodes 15*a* to 15*d* to the lead portions 21*b*, 22*c*, 26, 27*d*, respectively, and are provided at the cutout portions Ca to Cd. The connecting portions 16*a* to 16*d* cover the surfaces that define the cutout portions Ca to Cd, respectively. The connecting portions 16*a* to 16*d* are realized by forming a conductor film whose major constituent is Cu by plating. Alternatively, the connecting portions 16*a* to 16*d* may be made of a material which has a high electrical conductivity, such as Ag, Au, or the like.

Now, the positional relationship of the coil portion 25, the lead portions 21*b*, 22*c*, 26, 27*d*, and the connecting portions 16*a* to 16*d* is described with reference to the drawings.

As shown in FIG. 3A and FIG. 3B, the shortest distance D1 between the coil portion 25 and the connecting portion 16*d* is longer than the shortest distance D2 between the coil portion 25 and the lead portion 27*d*. The shortest distance D1 between the coil portion 25 and the connecting portion 16*a* is longer than the shortest distance D2 between the coil portion 25 and the lead portion 21*b*. The shortest distance D1 between the coil portion 25 and the connecting portion 16*b* is longer than the shortest distance D2 between the coil portion 25 and the lead portion 22*c*. The shortest distance D1 between the coil portion 25 and the connecting portion 16*c* is longer than the shortest distance D2 between the coil portion 25 and the lead portion 26.

Furthermore, as shown in FIG. 3B, the coil portions 20, 25 (although the coil portion 20 is not shown) do not overlap the connecting portions 16*a* to 16*d* (although the connecting portions 16*a* to 16*c* are not shown) when viewed in plan from the z-axis direction.

An operation of the electronic component 10 that is configured as described above is described hereinbelow. The external electrodes 15*a*, 15*c* are used as input terminals. The external electrodes 15*b*, 15*d* are used as output terminals.

Differential transmission signals, which are constituted of a first signal and a second signal with a phase difference of 180° therebetween, are input to the external electrodes 15*a*, 15*c*, respectively. The first signal and the second signal are in a differential mode and therefore produce magnetic fluxes of opposite directions in the coils L1, L2 upon passing through the coils L1, L2. The magnetic flux produced in the coil L1 and the magnetic flux produced in the coil L2 cancel each other. Thus, in the coils L1, L2, the increase/decrease of the magnetic fluxes which is attributed to flow of the first signal and the second signal hardly occurs. That is, the coils L1, L2 would not produce a counter electromotive force which can interrupt flow of the first signal and the second signal. Therefore, the electronic component 10 only has very small impedance for the first signal and the second signal.

On the other hand, if common mode noise is included in the first signal and the second signal, the common mode noise produces magnetic fluxes of the same direction in the coils L1, L2 upon passing through the coils L1, L2. Therefore, in the coils L1, L2, flow of the common mode noise increases the magnetic fluxes. Accordingly, the coils L1, L2 produce a counter electromotive force which interrupts flow of the common mode noise. Thus, the electronic component 10 has large impedance for the first signal and the second signal.

Method for Manufacturing Electronic Component

Hereinafter, a method for manufacturing the electronic component 10 is described with reference to the drawings. FIG. 4 through FIG. 7 are cross-sectional views of steps in manufacture of the electronic component 10.

Firstly, as will be described below, a mother body 110 is prepared in which a mother multilayer body 114 (see FIG. 4) that is a precursor of the multilayer body 14 is interposed between a mother substrate 112*a* (see FIG. 4) that is a precursor of the magnetic substrate 12*a* and a mother substrate 112*b* (see FIG. 4) that is a precursor of the magnetic substrate 12*b*.

Specifically, a polyimide resin which is a photosensitive resin is applied onto the entire principal surface S1 of the mother substrate 112*a*. Then, the resultant structure is exposed to light with portions corresponding to the four corners of the insulator layer 18*c* being shielded. Thereby, an unshielded part of the polyimide resin is cured. Thereafter, the photoresist is removed using an organic solvent, and development is carried out to remove an uncured part of the polyimide resin, and the remaining part is thermally cured. As a result, the insulator layer 18*c* is formed.

Then, a Ag film is formed on the insulator layer 18*c* by sputtering. Then, a photoresist layer is formed over regions in which the coil portion 25 and the lead portions 21*b*, 22*c*, 26, 27*d* are to be formed. Then, the Ag film, exclusive of portions formed over the regions in which the coil portion 25 and the lead portions 21*b*, 22*c*, 26, 27*d* are to be formed (i.e., portions covered with the photoresist layer), is etched away. Thereafter, the photoresist layer is removed using an organic solvent, whereby the coil portion 25 and the lead portions 21*b*, 22*c*, 26, 27*d* are formed.

The same procedure as that described above is repeated such that the insulator layers 18*a*, 18*b*, the coil portion 20, and the lead portions 21*a*, 21*b*, 22*a*, 22*b*, 27*a* to 27*c*, 30 are formed.

Figure 4A:
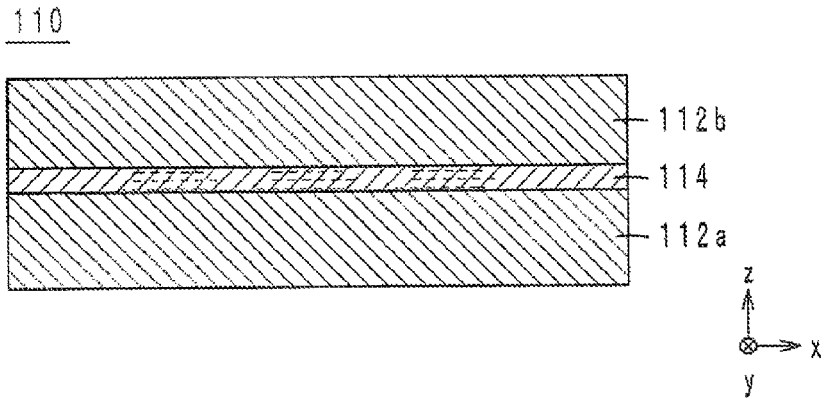
FIGS. 4A to 4C are cross-sectional views of steps in manufacture of the electronic component.

Then, the mother substrate 112*b* is adhered onto the mother multilayer body 114 by the organic adhesive agent layer 19. As a result, a mother body 110 is obtained as shown in FIG. 4A.

Figure 4B:
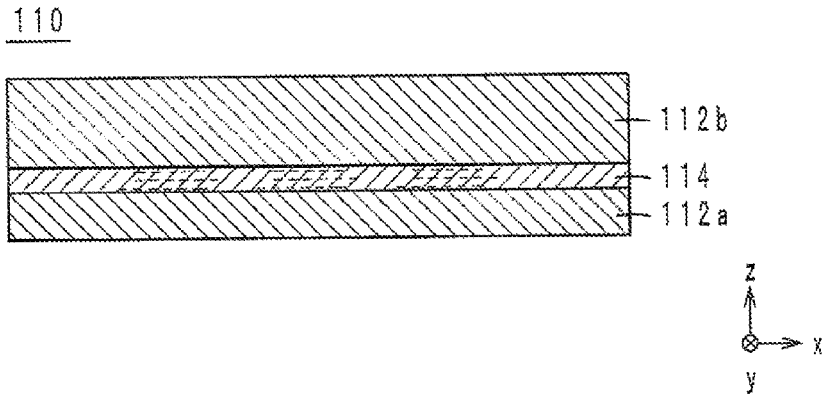

Then, as shown in FIG. 4B, a principal surface of the mother substrate 112*a* which is on the negative direction side of the z-axis direction is ground or abraded.

Figure 4C:
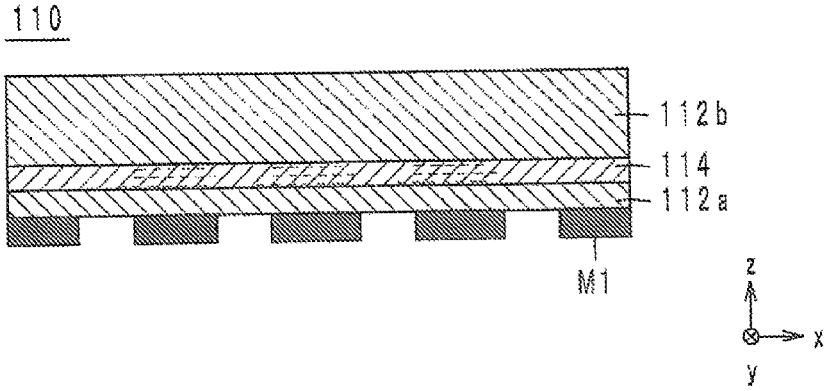

Then, as shown in FIG. 4C, a photoresist layer M1 is formed on the principal surface of the mother substrate 112*a* which is on the negative direction side of the z-axis direction such that the photoresist layer M1 is aligned with the coils L1, L2 that are present in the mother multilayer body 114. The photoresist layer M1 has openings in regions where the cutout portions Ca to Cd are to be formed.

Figure 5A:
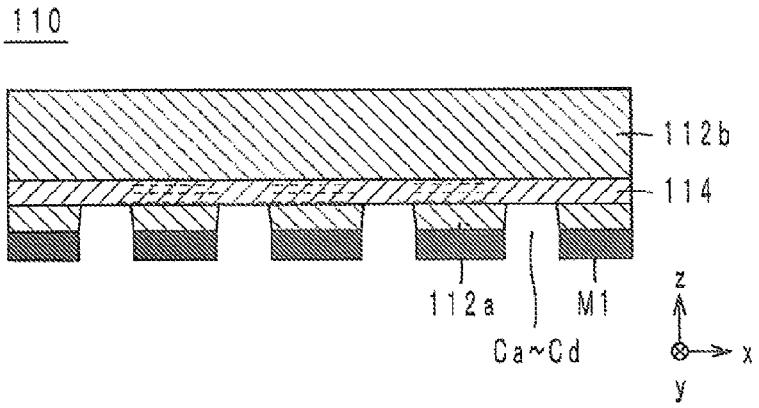
FIGS. 5A to 5C are cross-sectional views of steps in manufacture of the electronic component.

Then, as shown in FIG. 5A, through holes are formed in the mother substrate 112*a* by sandblasting via the photoresist layer M1 at positions where the cutout portions Ca to Cd are to be formed. Note that the through holes may be formed by laser processing rather than sandblasting, or may be formed by a combination of sandblasting and laser processing.

Figure 5B:
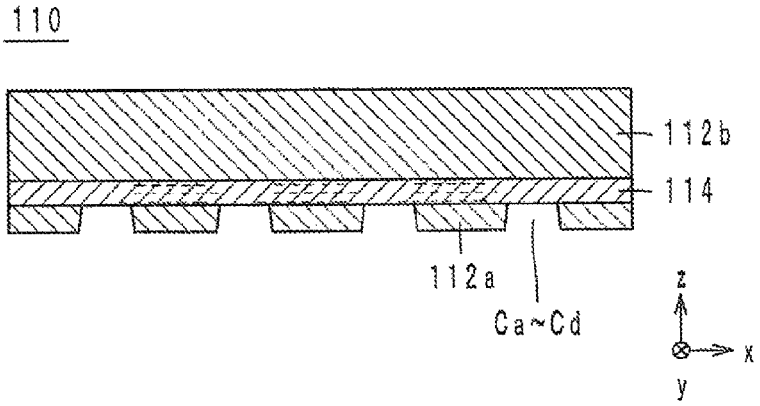

Then, as shown in FIG. 5B, the photoresist layer M1 is removed using an organic solvent.

Figure 5C:
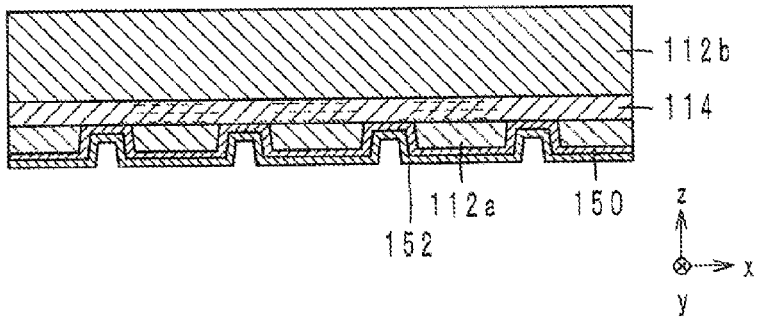

Then, as shown in FIG. 5C, over the entire principal surface of the mother body 110 which is on the negative direction side of the z-axis direction, a Ti thin film 150 and a Cu thin film 152 are formed by sputtering.

Figure 6A:
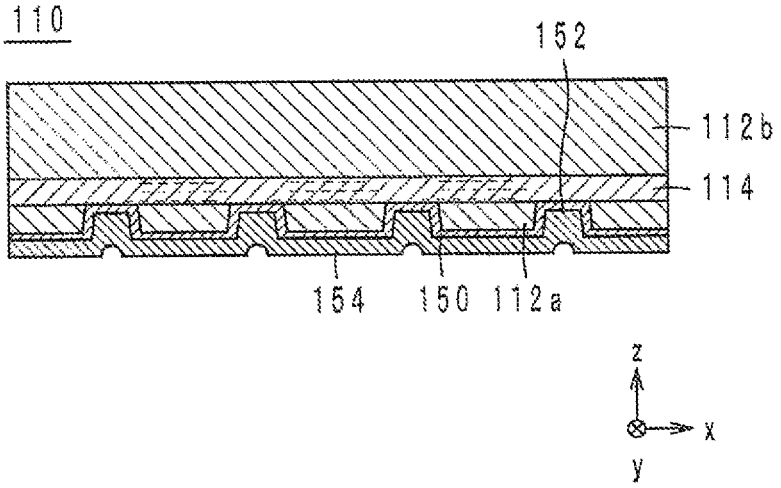
FIGS. 6A to 6D are cross-sectional views of steps in manufacture of the electronic component.

Then, as shown in FIG. 6A, a Cu plated film 154 is formed by electroplating using a Ti thin film 150 and a Cu thin film 152 as power supply films.

Figure 6B:
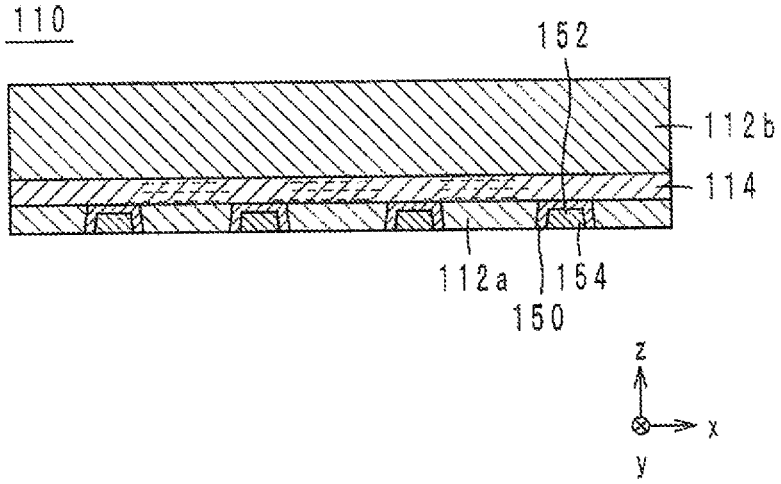

Then, as shown in FIG. 6B, the Ti thin film 150, the Cu thin film 152, and the Cu plated film 154, exclusive of portions formed in the through holes, are removed by wet etching, grinding, abrasion, CMP, or the like. Thereby, the principal surface of the mother body 110 which is on the negative direction side of the z-axis direction is flattened. Through the steps of FIG. 5C through FIG. 6B, a conductor layer is formed in the through holes, whereby the connecting portions 16*a* to 16*d* are formed.

Figure 6C:
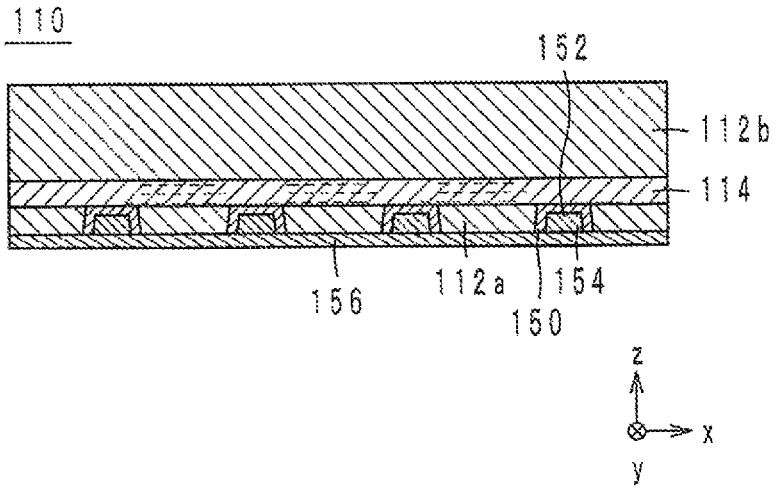

Then, as shown in FIG. 6C, a conductor layer 156, which is constituted of a Ti film, a Cu film, a Ni film, and a Au film that are stacked in this order from the lower layer to the upper layer, is formed by sputtering over the entire principal surface of the mother body 110 which is on the negative direction side of the z-axis direction. In the steps of FIG. 5C through FIG. 6C, the Ti thin film 150, the Cu thin film 152, the Cu plated film 154, and the conductor film 156 (conductor layer) are formed on the inner perimeter surface of the through holes and on the principal surface of the mother substrate 112*a* which is on the negative direction side of the z-axis direction.

Figure 6D:
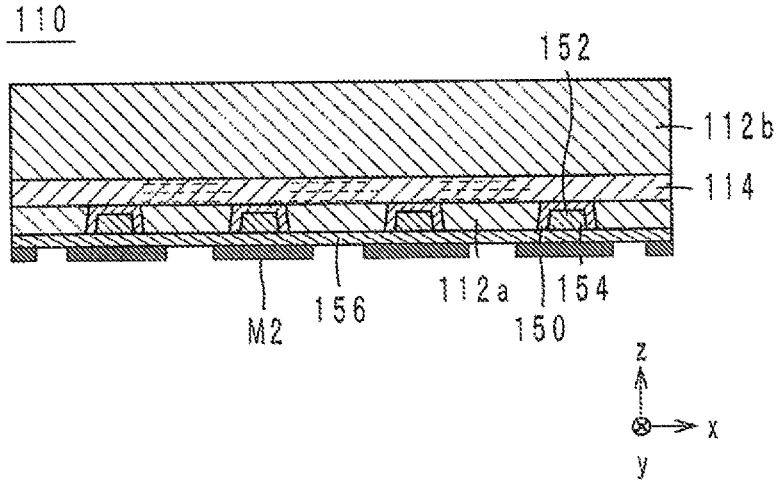

Then, as shown in FIG. 6D, a photoresist layer M2 (mask) is formed on the principal surface of the mother body 110 which is on the negative direction side of the z-axis direction. The photoresist layer M2 covers portions in which the external electrodes 15*a* to 15*d* are to be formed.

Figure 7A:
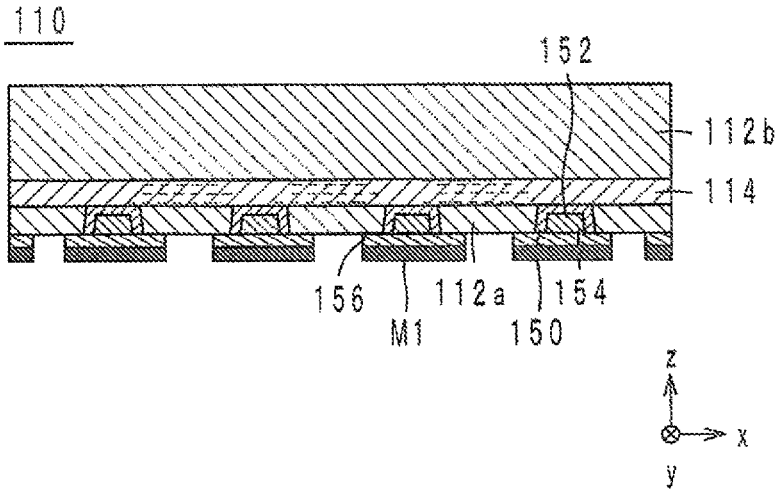
FIGS. 7A to 7D are cross-sectional views of steps in manufacture of the electronic component.
Figure 7B:
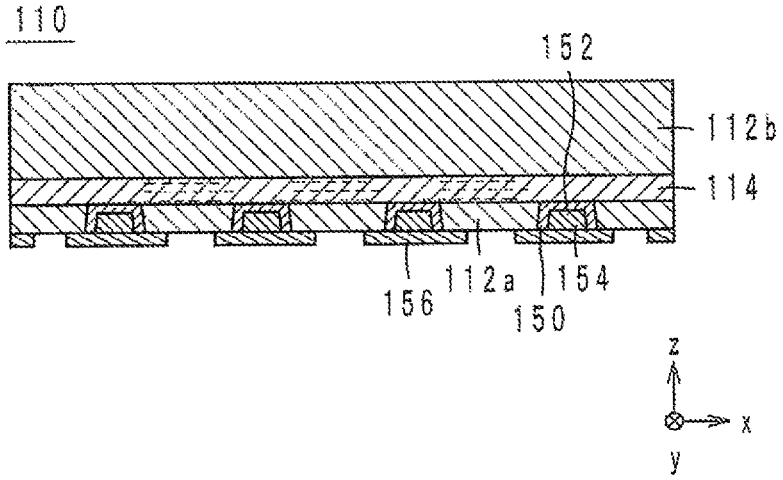

Then, as shown in FIG. 7A, the conductor layer 156, exclusive of the portions covered with the photoresist layer M2, is removed by etching. Then, as shown in FIG. 7B, the photoresist layer M2 is removed using an organic solvent. Through the steps of FIG. 6C through FIG. 7B, a conductor layer is formed on the principal surface of the mother substrate 112*a* which is on the negative direction side of the z-axis direction, whereby the external electrodes 15*a* to 15*d* are formed.

Figure 7C:
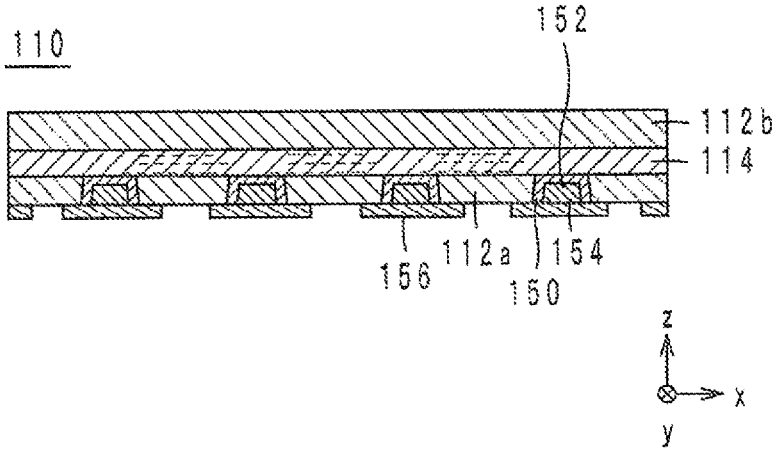

Then, as shown in FIG. 7C, a principal surface of the mother substrate 112*b* which is on the positive direction side of the z-axis direction is ground or abraded.

Figure 7D:
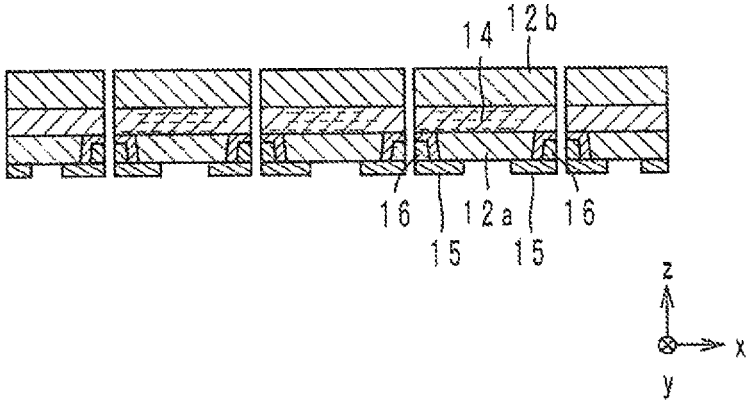

Then, as shown in FIG. 7D, the mother body 110 is cut by a dicer into a plurality of electronic components 10. In the step of FIG. 7D, the dicer is controlled to pass through the Ti thin film 150, the Cu thin film 152, and the Cu plated film 154 in the through holes. Thereby, the Ti thin film 150, the Cu thin film 152, and the Cu plated film 154 are divided into the connecting portions 16*a* to 16*d*. Thereafter, edges of the electronic components 10 may be rounded by barrel polishing. After the barrel polishing, the surfaces of the external electrodes 15*a* to 15*d* and the surfaces of the connecting portions 16*a* to 16*d* may undergo Ni plating and Sn plating for improving the solder wettability.

Effects

The electronic component 10 and the manufacturing method thereof according to the present embodiment enable a common mode choke coil which has a high impedance. More specifically, in the electronic component 500 described in Japanese Laid-Open Publication No. 2007-53254, a magnetic flux is unlikely to pass through the contact holes 508. Therefore, when the contact holes 508 are provided in the multilayer body 504, a magnetic flux generated by coil conductors is unlikely to pass through the contact holes 508. As a result, the coil conductors are incapable of having a sufficient inductance value, and a common mode choke coil formed by the coil conductors is incapable of having sufficient impedance.

On the other hand, in the electronic component 10, the magnetic substrate 12*a* has such a shape that the four ridges extending between the principal surfaces S1, S2 are cut away by cutout portions Ca to Cd. The connecting portions 16*a* to 16*d* that connect the external electrodes 15*a* to 15*d* to the lead portions 21*b*, 22*c*, 26, 27*d*, respectively, are provided at the cutout portions Ca to Cd. With this arrangement, the connecting portions 16*a* to 16*d* are provided at the most distant positions from the center of the magnetic substrate 12*a* when viewed in plan from the z-axis direction. That is, the connecting portions 16*a* to 16*d* are provided at the most distant positions in the magnetic substrate 12*a* from the coils L1, L2 when viewed in plan from the z-axis direction. As a result, a magnetic flux generated by the coils L1, L2 is prevented from being interrupted by the connecting portions 16*a* to 16*d*. Thus, the electronic component 10 and the manufacturing method thereof enable a common mode choke coil which has a high impedance.

In the electronic component 10, the coil portions 20, 25 do not overlap the connecting portions 16*a* to 16*d* when viewed in plan from the z-axis direction. With this arrangement, the connecting portions 16*a* to 16*d* are prevented from being present in the magnetic path of the magnetic flux generated by the coils L1, L2. As a result, in the electronic component 10, the inductance values of the coils L1, L2 increase, and the impedance of the common mode choke coil that is constituted of the coils L1, L2 increases.

In the electronic component 10, the coil portions 20, 25 do not overlap the connecting portions 16*a* to 16*d* when viewed in plan from the z-axis direction. With this arrangement, occurrence of capacitance between the coil portions 20, 25 and the connecting portions 16*a* to 16*d* is prevented. As a result, in the electronic component 10, the noise removal performance in a high frequency range improves.

In the electronic component 10, the multilayer body 14 that includes the coils L1, L2 is interposed between the magnetic substrates 12*a*, 12*b*. With this arrangement, a magnetic flux generated by the coils L1, L2 passes through the magnetic substrates 12*a*, 12*b*. As a result, the inductance values of the coils L1, L2 increase, and the impedance of the common mode choke coil that is constituted of the coils L1, L2 increases.

In the electronic component 10, the multilayer body 14 that includes the coils L1, L2 is interposed between the magnetic substrates 12*a*, 12*b*, and therefore, the inductance values of the coils L1, L2 increase. With this arrangement, the coils L1, L2 have sufficient inductance values even if the number of turns of the coil portions 20, 25 is small. As a result, the size of the coil portions 20, 25 can be reduced, and the size of the electronic component 10 can be reduced.

In the electronic component 10, as shown in FIG. 3A and FIG. 3B, the connecting portions 16*a* to 16*d* are prevented from being present in the magnetic path of the magnetic flux generated by the coil L2. As a result, in the electronic component 10, the inductance value of the coil L2 increases, and the impedance of the common mode choke coil that is constituted of the coils L1, L2 increases.

In the electronic component 10, when viewed in plan from the z-axis direction, the area of the cutout portions Ca to Cd decreases as it approaches from the principal surface S2 to the principal surface S1 (as it approaches toward the positive direction side of the z-axis direction). Therefore, the area of portions of the connecting portions 16*a* to 16*d* provided in the cutout portions Ca to Cd which are in contact with the lead portions 21*b*, 22*c*, 26, 27*d* is also small. Thus, the area of the lead portions 21*b*, 22*c*, 26, 27*d* can be reduced. As a result, a region for formation of the coil portions 20, 25 can be enlarged, and the inductance values of the coils L1, L2 can be increased without increasing the size of the electronic component 10.

In the electronic component 10, the surfaces that define the cutout portions Ca to Cd form obtuse angles θ with respect to the principal surface S2 as shown in FIG. 3B. With this arrangement, the surfaces that define the cutout portions Ca to Cd has such a shape that they become more distant from the coil portion 25. Therefore, the cutout portions Ca to Cd (i.e., the connecting portions 16*a* to 16*d*) are prevented from being present in the magnetic path of the magnetic flux generated by the coil portion 25. As a result, in the electronic component 10, the inductance value of the coil L2 increases, and the impedance of the common mode choke coil that is constituted by the coils L1, L2 increases.

Since the surfaces that define the cutout portions Ca to Cd form obtuse angles θ with respect to the principal surface S2, the discontinuity in shape is relaxed, so that concentration of the stress which is caused due to the difference in thermal expansion coefficient between the magnetic substrate 12*a*, the external electrodes 15*a* to 15*d* and connecting portions 16*a* to 16*d*, and a solder for use in mounting is relaxed.

Electronic Component According to First Variation

Figure 8:
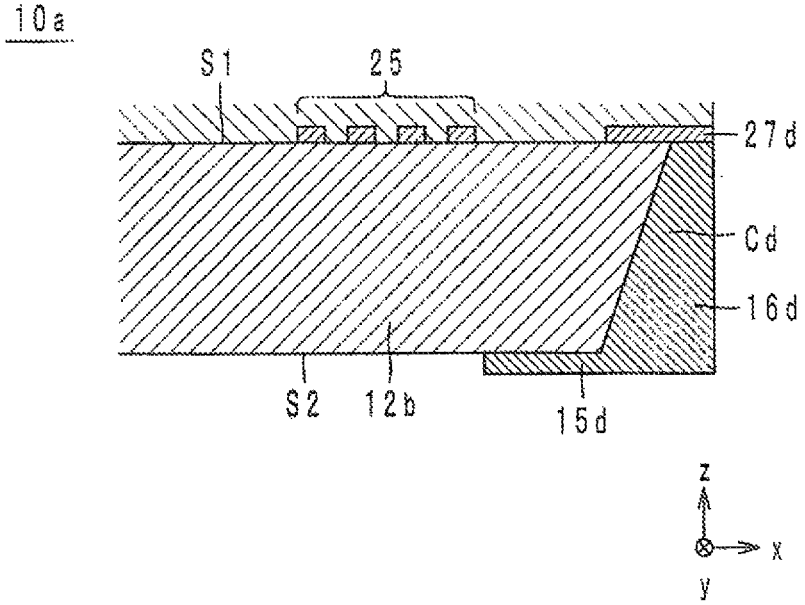
FIG. 8 is a cross-sectional configuration diagram of a portion of an electronic component according to the first variation in the vicinity of a connecting portion.

Hereinafter, an electronic component 10*a* according to a first variation is described with reference to the drawings. FIG. 8 is a cross-sectional configuration diagram of a portion of the electronic component 10*a* according to the first variation in the vicinity of the connecting portions 16*d*.

As shown in FIG. 8, the connecting portions 16*a* to 16*d* may have a frustum shape.

Electronic Component According to Second Variation

Figure 9:
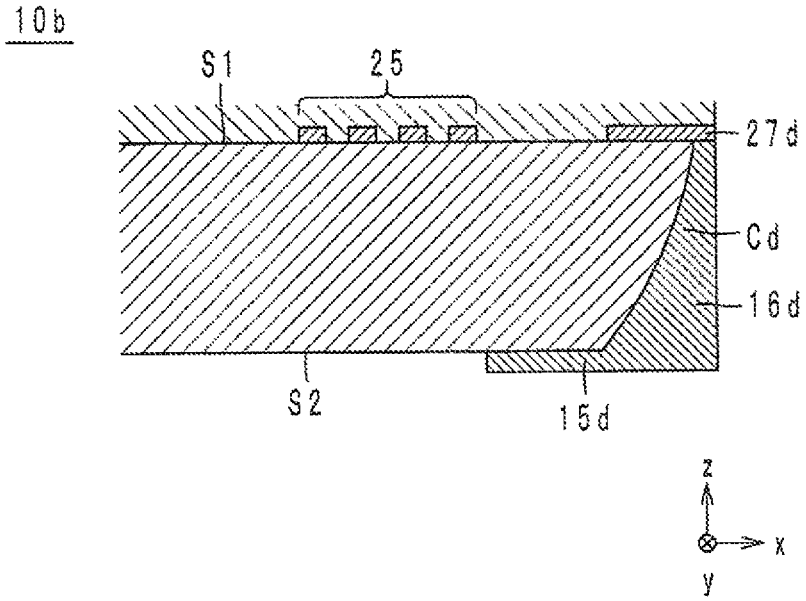
FIG. 9 is a cross-sectional configuration diagram of a portion of an electronic component according to a second variation in the vicinity of a connecting portion.

Hereinafter, an electronic component 10*b* according to the second variation is described with reference to the drawings. FIG. 9 is a cross-sectional configuration diagram of a portion of the electronic component 10*b* according to the second variation in the vicinity of the connecting portion 16*d*.

As shown in FIG. 9, the connecting portions 16*a* to 16*d* may have such a spindle shape that the gradient of the slope decreases as the position moves toward the negative direction side of the z-axis direction.

Electronic Component According to Third Variation

Figure 10:
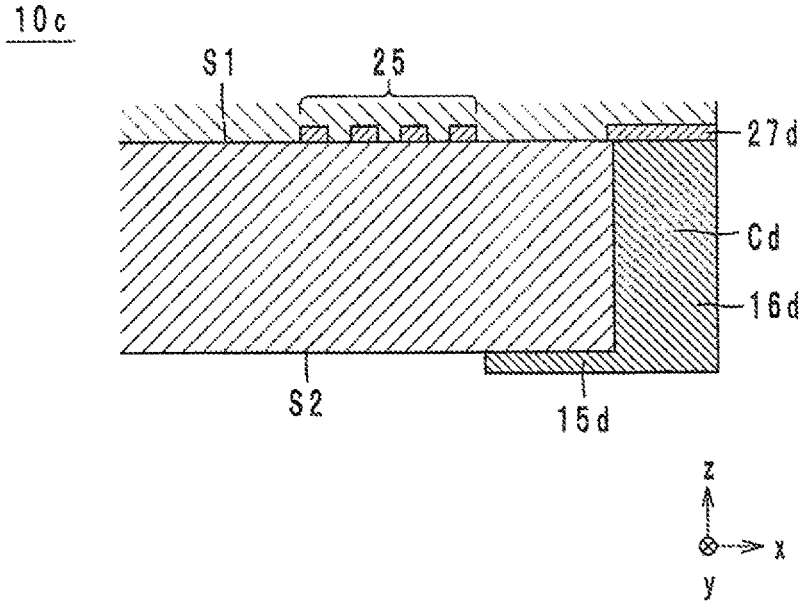
FIG. 10 is a cross-sectional configuration diagram of a portion of an electronic component according to a third variation in the vicinity of a connecting portion.

Hereinafter, an electronic component 10*c* according to the third variation is described with reference to the drawings. FIG. 10 is a cross-sectional configuration diagram of a portion of the electronic component 10*c* according to the third variation in the vicinity of the connecting portion 16*d*.

As shown in FIG. 10, the connecting portions 16*a* to 16*d* may have a cylindrical shape.

The electronic components 10*a* to 10*c* can be manufactured by changing the conditions of formation of the through holes in the mother substrate 112*a*. For example, if the through holes are formed by sandblasting, the conditions such as particle diameter, particle size, and material type of the processing powder may be changed. Alternatively, if the through holes are formed by laser processing, the power of the laser beam and the beam diameter may be changed.

Variation of Electronic Component Manufacturing Method

Next, a variation of the manufacturing method of the electronic component 10 is described with reference to the drawings. FIG. 11 and FIG. 12 show cross-sectional views of steps in a variation of the manufacturing method of the electronic component 10.

The process up to the step shown in FIG. 5C is the same as the manufacturing method of the electronic component 10 according to the previously-described embodiment, and the description thereof is herein omitted. In the step of FIG. 5C, a Ti thin film 150 and a Cu thin film 152 (first conductor layer) are formed on the inner perimeter surface of the through holes and on the principal surface of the mother substrate 112*a* which is on the negative direction side of the z-axis direction.

Figure 11A:
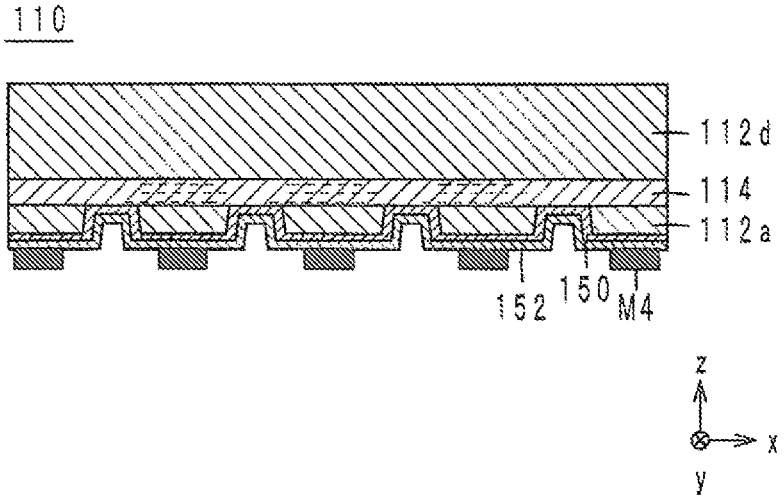
FIGS. 11A to 11D are cross-sectional views of steps in a method for manufacturing an electronic component according to a variation.

Then, as shown in FIG. 11A, a photoresist layer M4 (mask) is formed on the principal surface of the mother body 110 which is on the negative direction side of the z-axis direction. The photoresist layer M4 has openings in regions where the external electrodes 15*a* to 15*d* are to be formed.

Figure 11B:
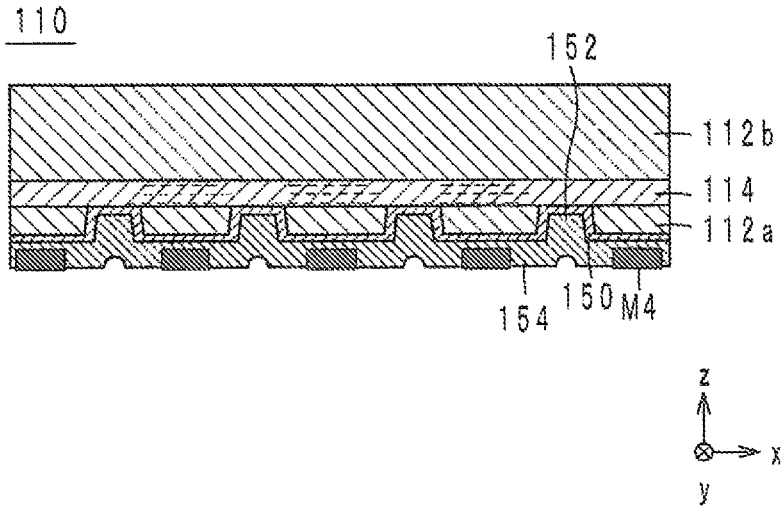

Then, as shown in FIG. 11B, a Cu plated film 154 is formed by electroplating using a Ti thin film 150 and a Cu thin film 152 as power supply films. As a surface oxidation protection film for the external electrodes 15*a* to 15*d*, Ni plating and Sn plating or Au plating are carried out on the Cu plated film 154. In the step of FIG. 11B, the Cu plated film 154 (second conductor layer) is formed on the Ti thin film 150 and the Cu thin film 152 (first conductor layer) exclusive of the portions covered with the photoresist layer M4.

Figure 11C:
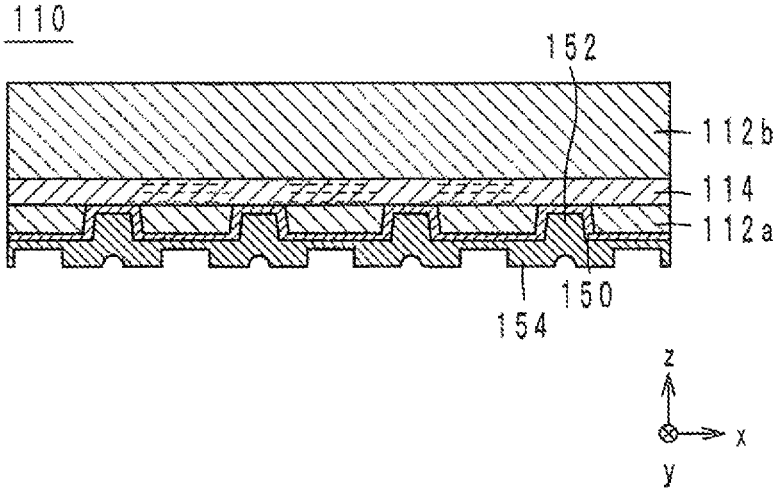

Then, as shown in FIG. 11C, the photoresist layer M4 is removed using an organic solvent. In this step, the portions in which the photoresist layer M4 has been provided are not provided with the Cu plated film 154, and therefore, the portions in which the photoresist layer M4 has been provided are recessed.

Figure 11D:
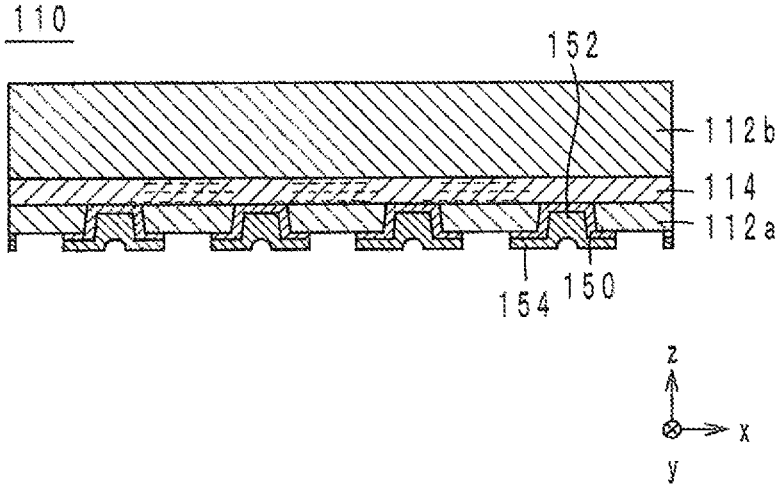

Then, as shown in FIG. 11D, the Cu plated film 154, the Ti thin film 150, and the Cu thin film 152 are removed by etching. Note that, however, as shown in FIG. 11D, the Cu plated film 154, the Ti thin film 150, and the Cu thin film 152 are not entirely removed. Specifically, the etching is carried out until the mother substrate 112*a* is exposed in portions where the external electrodes 15*a* to 15*d* are not provided (i.e., portions where the photoresist layer M4 is provided). In other words, the etching is carried out to an extent corresponding to the thickness of the Ti thin film 150 and the Cu thin film 152. Note that, however, even if the etching is carried out to an extent corresponding to the thickness of the Ti thin film 150 and the Cu thin film 152, the Cu plated film 154 remains because the Cu plated film 154 is provided in regions where the photoresist layer M4 is not provided as shown in FIG. 11C. Through the steps of FIG. 5C through FIG. 11D, a conductor layer is formed on the principal surface of the mother substrate 112*a* which is on the negative direction side of the z-axis direction, whereby the external electrodes 15*a* to 15*d* and the connecting portions 16*a* to 16*d* are simultaneously formed.

Figure 12A:
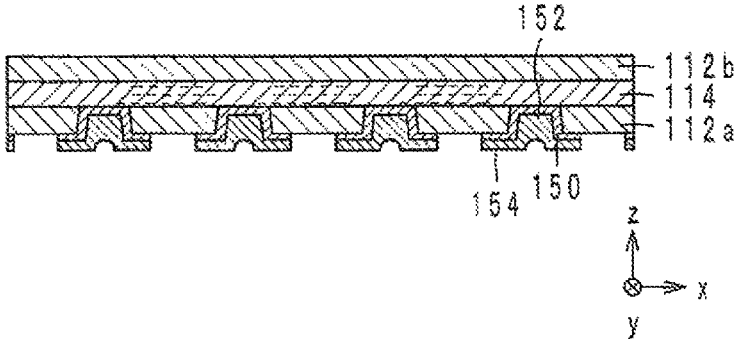
FIGS. 12A to 12B are cross-sectional views of steps in a method for manufacturing an electronic component according to a variation.

Then, as shown in FIG. 12A, a principal surface of the mother substrate 112*b* which is on the positive direction side of the z-axis direction is ground or abraded.

Figure 12B:
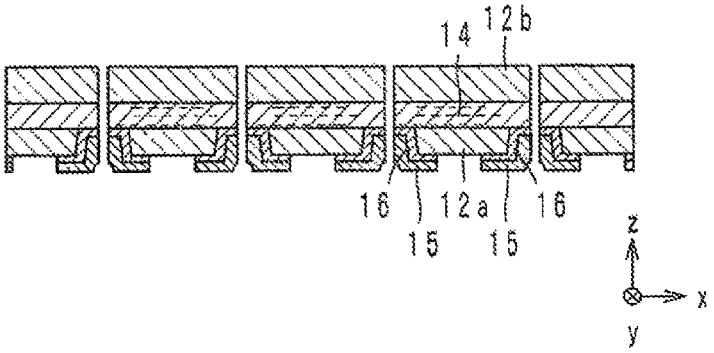
Figure 13:
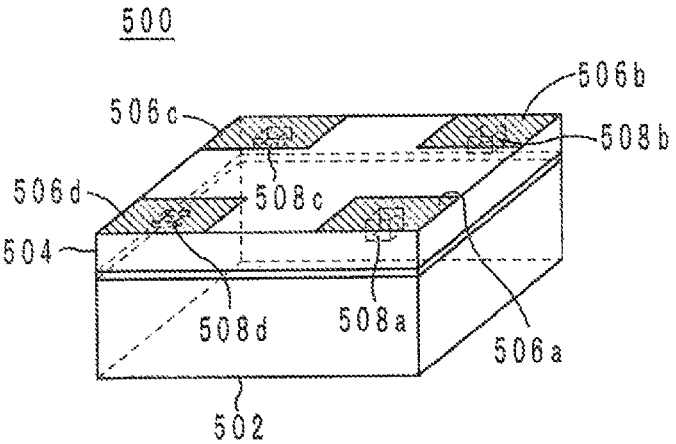
FIG. 13 PRIOR ART
FIG. 13 is a perspective view of the exterior of an electronic component described in Japanese Laid-Open Publication No. 2007-53254.

Then, as shown in FIG. 12B, the mother body 110 is cut by a dicer into a plurality of electronic components 10. In the step of FIG. 12B, the dicer is controlled to pass through the Ti thin film 150, the Cu thin film 152, and the Cu plated film 154 in the through holes. Thereby, the Ti thin film 150, the Cu thin film 152, and the Cu plated film 154 are divided into the connecting portions 16*a* to 16*d*. Thereafter, edges of the electronic components 10 may be rounded by barrel polishing. If layers of Ni plating and Sn plating or Au plating are not formed as the surface oxidation protection film in the step of FIG. 11B, the surfaces of the external electrodes 15*a* to 15*d* and the surfaces of the connecting portions 16*a* to 16*d* may undergo Ni plating and Sn plating or Au plating after the barrel polishing for improving the surface oxidation protection and the solder wettability.

According to the variation of the manufacturing method of the electronic component 10, the external electrodes 15*a* to 15*d* and the connecting portions 16*a* to 16*d* are concurrently formed. Therefore, the adhesion between the external electrodes 15*a* to 15*d* and the connecting portions 16*a* to 16*d* improves, so that the connection reliability between the external electrodes 15*a* to 15*d* and the connecting portions 16*a* to 16*d* can be improved and, at the same time, the manufacturing process can be simplified.

Other Embodiments

An electronic component and a manufacturing method thereof according to the present disclosure are not limited to the electronic components 10, 10*a* to 10*c* but can be modified within the scope of the spirit of the disclosure.

Note that, in the electronic component 10, 10*a* to 10*c*, it is only required that at least one of the connecting portions 16*a* to 16*d* is provided.

What is claimed is:

1. A method for manufacturing an electronic component including a first magnetic substrate having a shape of a substantially rectangular parallelepiped which has mutually opposing first and second principal surfaces, the first magnetic substrate having such a shape that a first ridge extending between the first principal surface and the second principal surface is cut away by a first cutout portion;

a multilayer body including a plurality of insulator layers stacked on the first principal surface, the multilayer body having a substantially rectangular shape which has a first corner that is arranged so as to overlap the first cutout portion when viewed in plan from a stacking direction in which the plurality of insulator layers are stacked;

a first coil provided in the multilayer body, the first coil including a first coil portion and a first lead portion which is connected with one end of the first coil portion and which is drawn out to the first corner;

a second coil provided in the multilayer body, the second coil being combined with the first coil to constitute a common mode choke coil, and including a second coil portion magnetically coupled with the first coil portion;

a first external electrode provided on the second principal surface; and a first connecting portion configured to connect the first external electrode to the first lead portion, the first connecting portion being provided at the first cutout portion, the first magnetic substrate has such a shape that second through fourth ridges extending between the first principal surface and the second principal surface are cut away by second through fourth cutout portions, respectively, the multilayer body has second through fourth corners that are arranged so as to overlap the second through fourth cutout portions, respectively, when viewed in plan from the stacking direction, the first coil further includes a second lead portion which is connected with the other end of the first coil portion and which is drawn out to the second corner, the second coil further includes third and fourth lead portions configured to be respectively connected with both ends of the second coil portion and to be drawn out to the third and fourth corners, respectively, and the electronic component further includes second through fourth external electrodes provided on the second principal surface, and second through fourth connecting portions configured to connect the second through fourth external electrodes to the second through fourth lead portions, respectively, the second through fourth connecting portions are provided at the second through fourth cutout portions, respectively, a second magnetic substrate configured to be combined with the first magnetic substrate so as to sandwich the multilayer body in the stacking direction, the method comprising the steps of:

preparing a mother body in which a mother multilayer body that is a precursor of the multilayer body is interposed between a first mother substrate that is a precursor of the first magnetic substrate and a second mother substrate that is a precursor of the second magnetic substrate;

forming through holes at positions in the first mother substrate at which the first through fourth cutout portions are to be formed;

forming a conductor layer on an inner perimeter surface of the through holes, thereby forming the first through fourth connecting portions;

forming a conductor layer on the second principal surface of the first mother substrate, thereby forming the first through fourth external electrodes; and cutting the mother body.

2. The method according to claim 1, wherein the step of forming a conductor layer on an inner perimeter surface of the through holes and the step of forming a conductor layer on the second principal surface of the first mother substrate are concurrently carried out.

3. The method according to claim 1, wherein the step of forming a conductor layer on an inner perimeter surface of the through holes and the step of forming a conductor layer on the second principal surface of the first mother substrate include the steps of:

forming a conductor layer on the inner perimeter surface of the through holes and on the second principal surface of the first mother substrate, forming a mask so as to cover portions of the conductor layer in which the first through fourth external electrodes are to be formed, and removing the conductor layer exclusive of the portions that are covered with the mask.

4. The method according to claim 1, wherein the step of forming a conductor layer on an inner perimeter surface of the through holes and the step of forming a conductor layer on the second principal surface of the first mother substrate include the steps of:

forming a first conductor layer on an inner perimeter surface of the through holes and on the second principal surface of the first mother substrate, forming a mask so as to cover portions of the first conductor layer in which the first through fourth external electrodes are to be formed, forming a second conductor layer on the first conductor layer exclusive of the portions that are covered with the mask, removing the mask, and carrying out etching on an entire surface of the second conductor layer such that portions of the second principal surface in which the first through fourth external electrodes are absent are exposed.

* * * * *